US010060425B2

(12) United States Patent
Schnekenburger et al.

(10) Patent No.: US 10,060,425 B2
(45) Date of Patent: Aug. 28, 2018

(54) TUBE MOUNT OF A ROLLER PUMP

(71) Applicant: Aesculap AG, Tuttlingen (DE)

(72) Inventors: Rolf Schnekenburger, Tuttlingen (DE); Simon Fluck, Blumberg (DE); Andreas Disch, Immendingen (DE)

(73) Assignee: Aesculap AG, Tuttlingen (DE)

( * ) Notice: Subject to any disclaimer, the term of this patent is extended or adjusted under 35 U.S.C. 154(b) by 677 days.

(21) Appl. No.: 14/420,949

(22) PCT Filed: Aug. 21, 2013

(86) PCT No.: PCT/EP2013/067368
§ 371 (c)(1),
(2) Date: Feb. 11, 2015

(87) PCT Pub. No.: WO2014/033023
PCT Pub. Date: Mar. 6, 2014

(65) Prior Publication Data

US 2015/0204321 A1 Jul. 23, 2015

(30) Foreign Application Priority Data

Aug. 30, 2012 (DE) ..... 10 2012 108 052

(51) Int. Cl.
*F04B 43/12* (2006.01)
*F04B 53/16* (2006.01)

(52) U.S. Cl.
CPC ..... *F04B 43/1238* (2013.01); *F04B 43/1276* (2013.01); *F04B 43/1284* (2013.01); *F04B 53/16* (2013.01)

(58) Field of Classification Search
CPC ..... F04B 43/1238; F04B 43/1276; F04B 43/1284; F04B 43/12; F04B 53/16; F04B 53/22

(Continued)

(56) References Cited

U.S. PATENT DOCUMENTS 3,675,653 A 7/1972 Crowley et al.
4,256,442 A 3/1981 Lamadrid et al.
(Continued)

FOREIGN PATENT DOCUMENTS

DE 2257618 6/1974
DE 94 11 183 9/1994
(Continued)

OTHER PUBLICATIONS

German Search Report with partial translation issued in related German Application No. 10 2012 108 052.6, dated May 6, 2013.
(Continued)

*Primary Examiner* — Dominick L Plakkoottam
*Assistant Examiner* — Philip Stimpert
(74) *Attorney, Agent, or Firm* — RatnerPrestia

(57) ABSTRACT

A peristaltic pump includes a housing in which a tube mounting case is formed in which a pump head is rotatably supported. The pump includes a tube unit provided as a replacement part consisting of a flexible tube and a tube fixture which holds the tube at two positions. The tube unit is insertible in the tube mounting case so that by displacing the tube fixture, the tube enters into tensioning engagement with the pump head. A tensioning device is arranged on the housing or on the tube mounting case in the form of a lever mechanism for tensioning displacement of the tube fixture by at least one lever element. A locking or clamping mechanism forms an undercut which upon reaching a tube tensioning position engages in a counter-locking/clamping mechanism arranged on the tube fixture for locking the tube fixture and the tensioning device in the tube tensioning position.

10 Claims, 8 Drawing Sheets

(58) Field of Classification Search
USPC ..... 417/477.2, 477.13
See application file for complete search history.

(56) References Cited

U.S. PATENT DOCUMENTS

| | | | | |
|---|---|---|---|---|
| 4,813,855 | A | 3/1989 | Leven et al. | |
| 4,925,376 | A | 5/1990 | Kahler | |
| 5,096,393 | A | 3/1992 | Van Steenderen et al. | |
| 5,443,451 | A | 8/1995 | Chapman et al. | |
| 5,928,177 | A | 7/1999 | Brugger et al. | |
| 6,406,267 | B1 | 6/2002 | Mondiere | |
| 7,704,057 | B2 | 4/2010 | Malbec et al. | |
| 2004/0037724 | A1 | 2/2004 | Haser et al. | |
| 2005/0069436 | A1 | 3/2005 | Shibasaki | |
| 2005/0254978 | A1 | 11/2005 | Huber et al. | |
| 2006/0083644 | A1 | 4/2006 | Zumbrum et al. | |
| 2007/0020130 | A1 | 1/2007 | Malbec et al. | |
| 2011/0165005 | A1* | 7/2011 | Maitre ..... | A61M 3/0258 418/45 |
| 2011/0300010 | A1 | 12/2011 | Jamagin et al. | |

FOREIGN PATENT DOCUMENTS

| | | | |
|---|---|---|---|
| DE | 9411183 | U1 | 10/1994 |
| DE | 202 17 483 | U1 | 10/2003 |
| DE | 20 2011 051 141 | U1 | 12/2011 |
| EP | 0547726 | A1 | 6/1993 |
| EP | 1 518 572 | A1 | 3/2005 |
| EP | 1518572 | A1 | 3/2005 |
| JP | 2007509267 | A | 4/2007 |
| WO | 0248549 | A1 | 6/2002 |
| WO | WO 2004/044425 | A1 | 5/2004 |

OTHER PUBLICATIONS

Written Opinion and International Search Report with partial translation issued in related International Application No. PCT/EP2013/067368, dated May 26, 2014.
Japanese Office Action with English language translation for JP 2015-528960, dated Jun. 9, 2017, 5 pages.
German Search Report for German Application No. 10 2011 081 722.0, dated May 23, 2012 with partial transiation, 6 pages.
Extended European earch Report for European Application No. 12180276.3, dated Jan. 14, 2013, 6 pages.
European Communication for European Application No. 12180276.3, dated Mar. 27, 2014, 5 pages.
Final Office Action for U.S. Appl. No. 13/593,921, dated Apr. 10, 2015, 17 pages.
Final Office Action for U.S. Appl. No. 13/593,921, dated Feb. 24, 2016, 16 pages.
Non Final Office Action for U.S. Appl. No. 13/593,921, dated Aug. 11, 2015, 20 pages.
Non Final Office Action for U.S. Appl. No. 13/593,921, dated Nov. 19, 2014, 20 pages.

* cited by examiner

TUBE MOUNT OF A ROLLER PUMP

RELATED APPLICATIONS

This application is the U.S. National Phase of International Application No. PCT/EP2013/067368, filed Aug. 21, 2013, which claims the benefit of priority of German Application No. DE 10 2012 108 052.6, filed Aug. 30, 2012, the content of both applications being incorporated by reference herein in their entireties.

FIELD

The present invention relates to a peristaltic pump and especially to a tensioning device arranged in/at a tube mounting case of the peristaltic or, respectively, roller pump (squeeze pump) for applying tension to a tube insertible in the tray, preferably a one-way tube.

BACKGROUND

Roller or peristaltic (squeeze) pumps are positive displacement pumps in which the fluid to be conveyed is pressed through a tube by elastic external mechanical deformation of the same. Due to the smooth conveying of the fluid (without shearing or swirling the latter) peristaltic pumps are also used especially for medical purposes.

A flexible/elastically deformable tube is basically inserted in the housing of a generic peristaltic pump so that it is guided around a rotatable pump head over a predetermined peripheral section on which a number of angularly spaced rollers are rotatably supported which upon appropriate rotation of the pump head are sequentially brought into rolling engagement with the tube and compress/squeeze off the same. The tube is supported either on the outside of the pump housing or it is tensioned around and against the pump head at a predetermined tensile force.

In each design the movement of the pump head results in the fact, however, that the respective squeeze-off position of a just engaging roller moves forward along the tube and thereby advances the fluid to be pumped inside the tube portion immediately upstream of the respective roller. The suction vacuum in the tube portion immediately downstream of the respective roller is generated, as a rule, by the inherent elasticity of the tube material by virtue of which the tube attempts to regain its original constructional shape.

Due to the increasingly stricter hygienic regulations as well as more demanding user requests, it has become common practice to design at least those components of a peristaltic pump especially when used in the medical field as one-way articles which get in direct contact with the fluid to be pumped. These include primarily the tube which consequently has to be most easily removable and insertible. For this purpose, a plurality of tube units and tensioning devices are known from the state of the art, some of which shall be mentioned hereinafter:

Basically it is possible to pre-mount both the tube and the pump head in a kind of cartridge as a separate tube unit which during a replacing operation merely has to be inserted/locked in the housing of the peristaltic pump such that the pump head is engaged to co-rotate with a drive shaft of an electric motor or a gear unit connected thereto, for example. Although this solution strongly facilitates the replacing operation and at the same time also ensures high operating reliability, as the cartridge can be designed as a closed housing unit, whereby rotating elements are encased so as to be inaccessible from outside, this constitutes a comparatively expensive design variant.

The pump head is a rather complicated component consisting of a plurality of single parts movable/rotating relative to each other (as indicated already before) which actually would not have to be replaced, because it is not directly contaminated by the fluid to be pumped. Therefore it is by far less expensive to provide merely the tube as one-way article. For exchanging the latter, however, the tube has to be removed from the pump head and attached thereto again, wherein a pretensioning force has to be overcome by which the tube is tensioned around the pump head. In order to facilitate replacement of merely the tube (with the pump head being retained), therefore a specific tensioning mechanism has been developed by which the tube can be relaxed and tensioned for an exchanging operation.

G 94 11 183 discloses a simple design of such tensioning device. Accordingly, the tube is provided/configured with two axially spaced bead-like stops/holding fixtures, whereas the pump housing is provided inside the tube mounting case formed or inserted therein with a transverse strip or beam as tube mount in which two notches are formed. In order to insert the tube into the tube mount the one beaded stop is locked/hooked into the one notch and subsequently the tube is pulled around the pump head. Finally the other beaded stop is locked/hooked into the other notch. This inserting operation is very time-consuming and complicated as the stops have to be hooked into the notches under tensile stress of the tube, which requires particular skills and force by an operating person.

As an alternative to this, it is also possible to provide a driving beam as tube mount which at its two axial ends is tightly connected to the tube at two axially spaced tube portions so that the tube (central tube portion) forms a loop between the beam ends. The beam and the tube thus constitute a separate replaceable tube unit.

The tube formed in this way is now laid/guided over the pump head with its loop area and the driving beam is locked in a tensioning device. The tensioning device preferably provides a guide rail/groove for the driving beam along which the driving beam is displaced while the loop area is tensioned, until the driving beam engages in a detachable mount/locking inside the tube mounting case. Although this design facilitates the inserting operation of the tube, the tube has to be tensioned in the area of the loop simultaneously at two ends of the loop area and thus at two flanks forming relative to the pump head, which requires a greater effort which cannot be applied by any operating person.

Finally, the exchange of merely the tube (and not the pump head) requires free access from outside even to the rotating components which either remains opened also during operation for reasons of cost or can be at least partly closed by means of an additional service/protective door. The latter does not only render the peristaltic pump more expensive, but also constitutes a source of danger in so far as the door has to be closed in an additional step, which might be forgotten.

SUMMARY

In view of the aforementioned problems, it is an object of the present invention to provide a peristaltic pump of the present species which exhibits increased functionality. It is an objective to facilitate the inserting operation for a tube or for a tube unit especially of the one-way type. It is another objective to improve the safety of the peristaltic pump.

Finally it is an objective of the invention to keep the peristaltic pump and especially the replacement tube unit cost-efficient.

The aforementioned object and the further objectives are achieved by a peristaltic pump comprising features that are described herein. Advantageous configurations of the invention are also described herein.

Consequently, it is a basic idea of the invention to equip the peristaltic pump with a tube mounting case into which the tube can be inserted in an almost loose condition. Moreover, the peristaltic pump includes a tube tensioning device including a lever mechanism preferably being manually operable or motor-driven so as to tension the tube over a predetermined peripheral portion around the rotating (stationary) pump head of the peristaltic pump. The operating force required for reaching the required tensioning force and thus the pressing force against the pump head can be reduced by the lever mechanism so that it can be applied simply manually without additional separate tools being necessary. In the case of a motor-driven operation of the lever mechanism the drive can be dimensioned to be small and thus cost-effective.

Basically plural constructional designs are imaginable as lever mechanisms with the aid of which an operating movement can be transferred with appropriate step-down to the tube/tube unit, for example a worm gear, a pulley block, a gear drive or similar auxiliary means. Concretely speaking, it is advantageous, however, to design the lever mechanism, especially in the case of manual operation, conventionally in the form of an operating element (handle) hinged to the peristaltic pump and being coupled (operatively connected) to a movable component or push rod member transferring shear force which transmits an operating force generated by swiveling at the handle to the tube after being reduced depending on the type/place of coupling. Such concept for the lever mechanism can be easily manufactured, is functionally reliable and thus economic.

According to an aspect of the invention, consequently a medical peristaltic pump is suggested comprising a pump housing in which a tube mounting case is formed or accommodated in which a pump head/pump rotor is rotatably (preferably stationarily) accommodated, as well as comprising a tube unit inserted into the tube mounting case such that a tube of the tube unit is or can be engaged in the pump head while at least partly encompassing the same (while the tube undergoes an elastic linear extensional strain).

The tension force (also tensile force) by which the tube contacts or is to contact the pump head, is applied by a pulling/tensioning device arranged on the pump housing (i.e. provided as a fixed part of the peristaltic pump) which interacts with the tube unit or the pump head so that upon (manual/motor-driven) operation thereof the tube is tensioned around the pump head. In accordance with the invention, the tensioning device includes/is a lever mechanism fixedly installed on the pump housing and thus not to be regarded as a tool.

Due to this configuration, a tube or a tube unit can be easily inserted and tensioned by any person. The removal of a tube or tube unit is carried out in an equally simple manner in that the pre-tension of the tube around the pump head is released via the lever mechanism and then the tube/tube unit is removed from the tube mounting case so-to-speak without force. Since the lever mechanism is part of the peristaltic pump, it is not exchanged as well each time so that the operation of the peristaltic pump remains cost-effective.

In accordance with the invention, the tube unit is thus preferably formed as a replacement part of the flexible tube and a beam-type tube fixture which holds the tube at two positions longitudinally spaced apart from the tube (while forming a tubing loop). Furthermore, the tensioning device arranged on the pump housing or on the tube mounting case is provided in the form of the lever mechanism for displacing (for tensioning the tube) preferably the tube fixture (or the pump head) by at least one lever element (operating element or push rod component according to the aforementioned definition) at which a clamping means or an engaging means forming an undercut is provided which, upon reaching a tube tensioning position, engages in a counter-clamping/locking means disposed at the tube fixture of the (exchangeable) tube unit for locking the tube fixture and the tensioning device in the tube tensioning position thereof.

In other words, a lever element (operating element of the lever mechanism) is swiveled for tensioning the tube around the pump head (preferably moved in the direction of the tube mounting case). At the same time, this swivel motion of the one lever element is transformed by the entire lever mechanism into a displacing motion preferably of the tube fixture (or the pump head) in the tube tensioning direction. As soon as the lever element is completely shifted, also the tube fixture (or the pump head) is maximally displaced and the tube is maximally tensioned around the pump head. In this position the clamping/locking means on the side of the lever element is engaged in the counter-clamping/locking means on the side of the tube fixture and in this way obstructs or prevents inadvertent swiveling of the lever element and/or displacement of the tube fixture (in the case of a stationary pump head) even when the lever mechanism becomes defective at one position. In this way the safety of the peristaltic pump is increased.

Preferably a lever element of the lever mechanism at the same time is/includes a protective cap for at least partly covering the tube mounting case (on the front side). In this way upon operating the tensioning device the tube mounting case is simultaneously (automatically) opened and/or closed and thus the moving parts provided therein such as the pump head or the tube are protected to the outside. This equally increases the safety of the peristaltic pump.

Another aspect of the invention may provide that the protective cap either constitutes or is fixed to the lever element which is provided as handle (operating element) of the lever mechanism or constitutes or is fixed to the lever element (push rod element) which is operable via the handle to transmit the lever force to the tube fixture. As already explained in the beginning, the lever mechanism according to the invention includes an operating element or a handle which is directly or indirectly hinged to the pump housing and a push rod element which is operatively connected to the lever for force transmission. The protective cap thus can be associated either with the handle or with the push rod element.

In case that the handle at the same time includes or is the protective cap, the latter may take the shape of a cover plate. In case that the force transmission lever element (push rod element) includes or is the protective cap, the handle may take the shape of a bow-type handle, a buckle/operating key, a knee lever or a similar ergonomic design. Since the protective function and the operating function are thus associated with different elements of the lever mechanism, they can be optimally adapted in terms of design to the remaining function thereof without making any compromise.

In accordance with another aspect of the invention, a tube mount (hook-in part) may preferably be provided as part of the lever mechanism which is or can be arranged movably in or at the tube mounting case and in which the tube can be or is insertible or inserted/hooked in via the tube fixture formed or fixed thereon.

In the preferred case of the movable tube mount it is advantageously provided that the lever mechanism acts on the tube mount preferably as a further element of the lever mechanism so as to move the same relative to the stationary (not movable) pump head (while driving the tube fixture) so that the free (loop-shaped) central tube portion contacts the pump head in an encompassing manner. The central tube portion can also be almost straight or else already pre-looped in the inserted loose state.

Moreover, it may be of advantage when the lever mechanism is configured to be self-locking in addition to the locking/counter-locking means, i.e. when the handle swivels over kind of a dead center when it is operated for tensioning the tube and then folds/snaps into its final tensioning position quasi automatically.

In addition, a stop or stop projection may be provided which is formed in the tube mounting case and which upon reaching the tube tensioning position presses against the tube fixture (or the tube mount) so as to block any further displacement thereof in the tube tensioning direction.

Finally it is provided according to another aspect of the invention to provide a tube unit for a peristaltic pump according to the invention (preferably in the form of a one-way component separate from the peristaltic pump according to the invention) comprising a beam-type tube fixture (engaging device) which holds the flexible, preferably elastic tube at two axially spaced positions or is tightly connected to the tube at said positions and forms at least one undercut adapted to be brought in retaining engagement with the tube mount of the peristaltic pump and/or the tensioning device of the peristaltic pump. In this way the tube unit can be manufactured in a very cost-effective manner due to the small number of components and is therefore especially suited as one-way article.

Furthermore, on the tube fixture a tab projecting transversely thereto is formed which is adapted for manual handling of the tube unit during the mounting/dismounting operation and preferably for locking the tensioning device/lever mechanism in the tube tensioning position thereof. This facilitates the handling of the tube unit. At the same time, the counter-locking element (tab) provided for locking the tensioning device on the side of the tube unit is also replaced with each replacement. Thus the counter-locking element can be manufactured of an inexpensive material (together with the tube fixture) as a one-way article, because the durability thereof need not be taken into consideration.

BRIEF DESCRIPTION OF THE DRAWING FIGURES

Hereinafter the invention shall be illustrated in detail by way of embodiments with reference to the accompanying drawings.

DETAILED DESCRIPTION

Figure 1:
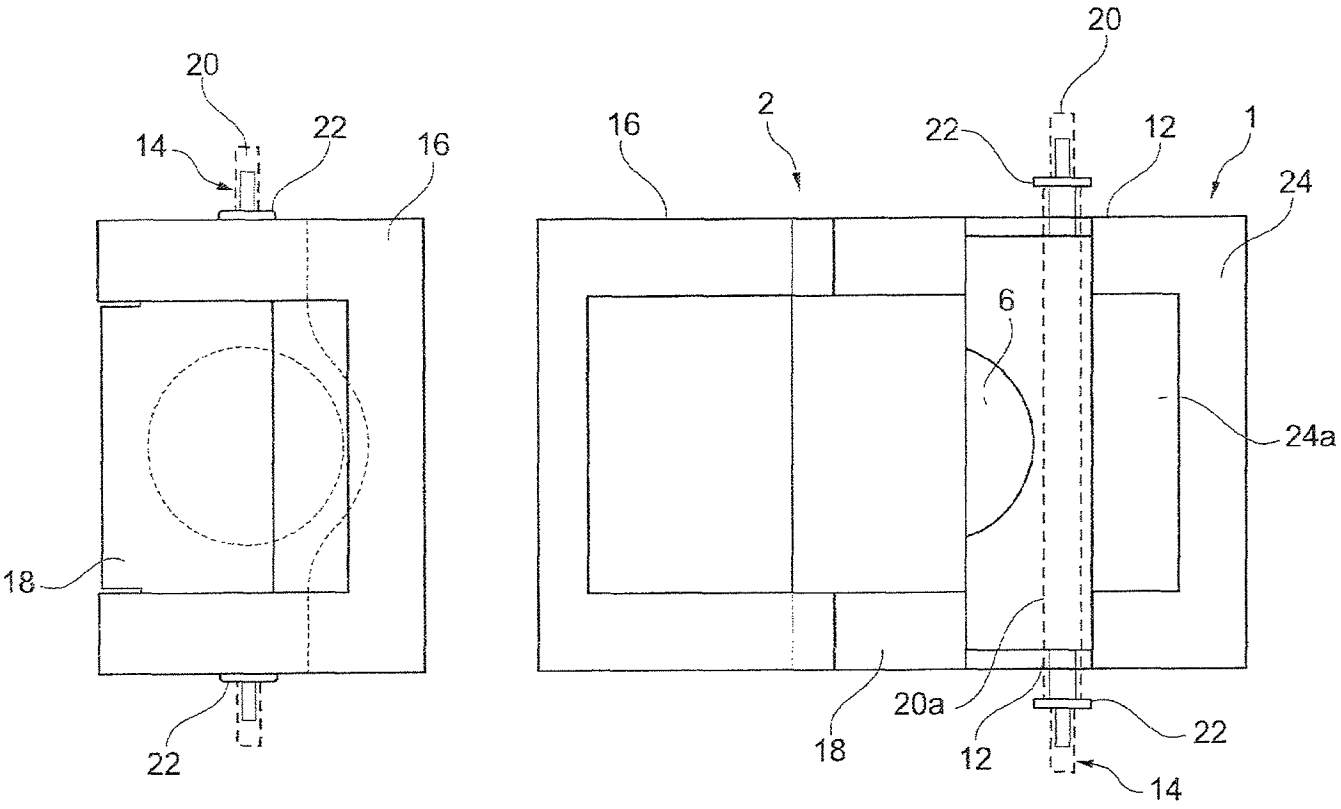
FIG. 1 shows a first preferred embodiment of the invention comprising a manually operable lever mechanism as a tensioning device including a stationary tube mount and a bow-type handle in the open (loose) and closed (tensioned) state.
Figure 8:
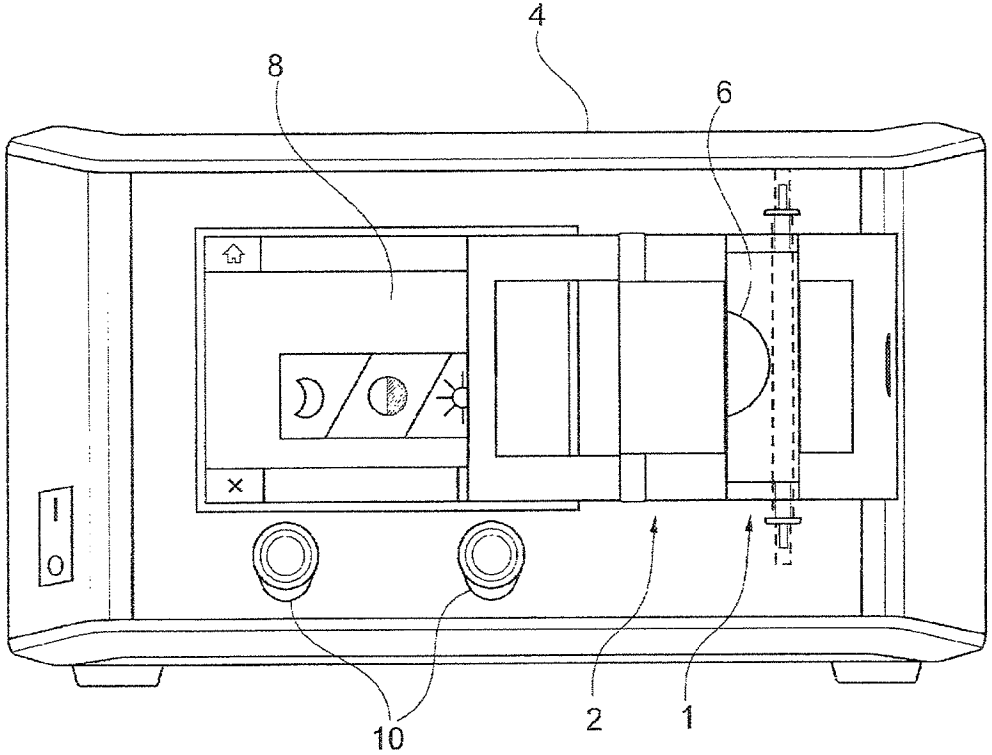
FIG. 8 shows an illustrative example of the housing of a peristaltic pump according to the invention comprising a bow-type handle according to FIG. 1 and especially the tube mounting case in the open (loose) state.

In FIG. 1, a tube mounting case 1 of a peristaltic pump according to FIG. 8 is shown in detail which is equipped with a tensioning device including a lever mechanism 2. As can be inferred from FIG. 8, the peristaltic pump of the invention basically includes a pump housing 4 at the front side of which in this case the tube mounting case 1 is arranged so that it opens toward the front side of the pump housing 4. Inside the tube mounting case 1 a pump head 6 is provided consisting of a motor-driven rotatable drive wheel at the radial outer periphery of which a number of pressure wheels/rollers (not shown in detail) are supported to be rotatable relative to each other which are equally spaced over the periphery. A control panel 8 which is equally placed on the front side of the pump housing 4 serves for programming a control at least for the electric drive of the pump head so as to adjust, for example, the speed or turn-on and turn-off times of the peristaltic pump. Moreover on and off buttons are arranged on the front side of the pump housing.

In the embodiment according to FIG. 1 the tube mounting case 1 is in the form of a substantially rectangular bowl or recess which is either manufactured integrally with the pump housing 4 or is inserted as a separate component in an appropriate cutout of the pump housing 4. On each of two opposing walls of the tube mounting case 1 a respective notch 12 is formed which may serve as tube mounts and in which a tube or a tube unit 14, resp., can be inserted. The notches 12 are aligned with each other for this purpose so that the alignment thereof is arranged radially offset with respect to the pump head 6.

On a side of the tube mounting case 1 extending in parallel to the alignment the tensioning device including the lever mechanism 2 is supported on the pump housing 4. This lever mechanism in the present case consists of a handle 16 in the form of a bow-type handle pivotally hinged to the pump housing 4 which is operatively connected to a pushing element (push rod member) 18 by means of a joint (not shown), a spring means or a gear unit. In the top view according to FIG. 1 the pushing element 18 has a substantially rectangular plate shape whose size is sufficient to largely or even completely cover the tube mounting case 1. The pushing element 18 is further connected to the axis of rotation of the pump head 6 and in the present case constitutes a bearing for the axis of rotation.

For example, the pushing element 18 may consist of two plates spaced in parallel which are fixed to each other and between which the pump head is rotatably held. In this case it is also of advantage when the drive motor (not shown in detail) for the pump head 6 is equally fastened to the pushing element 18. The pushing element 18 is movably guided on the pump housing 4 such that it cannot be lifted off the pump housing 4. The bearing of the pump head 6 is furthermore chosen so that the pump head 6 projects from the pushing element 18 at the plate edge of the pushing element 18 facing the alignment.

From FIG. 1 also the tube unit 14 is evident which is provided, according to the invention, as a component separate from the peristaltic pump and can optionally be inserted in the tube mounting case 1.

Hence the tube unit 14 consists of a flexible preferably elastically deformable tube 20 (stretchable in the longitudinal tube direction) on which two holding fixtures or engaging elements 22 altogether constituting the tube fixture of the tube unit are fastened or formed at an axial distance from each other. These holding fixtures 22 form radial peripheral projections or collars adapted to be brought in undercutting engagement with the notches 12 on the tube mounting case 1. The axial distance of the holding fixtures 22 is selected so that, when the tube 20 is inserted in the two notches 12 so that the holding fixtures 22 contact the tube mounting case 1 behind the notches 12, the central tube portion 20*a* extending there between is not or only slightly tensioned and thereby follows substantially the alignment.

On the side of the alignment opposite with respect to the pushing element 18 the tube mounting case 1 is partially covered by a fixed plate 24, the fixed plate 24 having an inner bulge 24*a* into which the part of the pump head 6 projecting from the plate-shaped pushing element 18 in the direction of the alignment immerses or enters when the tube mounting case 1 is closed.

The functioning of the peristaltic pump according to the first preferred embodiment of the invention can be described as follows by way of the FIGS. 1 and 8.

In accordance with FIG. 1, right-hand representation, the tube mounting case 1 is opened by the bow-type handle 16 according to FIG. 1 being manually unfolded to the left, whereby the plate-shaped pushing element 18 is displaced together with the pump head 6 via the lever mechanism to the left, i.e. away from the alignment. In this (opened loose) position the tube unit 14 now can be inserted without any effort and thus easily into the notches 12 as described before.

Subsequently the bow-type handle 16 is manually folded in the direction of the alignment, wherein said folding or swivel motion is transferred via the lever mechanism with an appropriate reduction to the plate-shaped pushing element 18 for displacing the same. That is to say that by swiveling the handle 16 in the direction of the alignment the plate-shaped pushing element 18 is pushed forward in the direction of the fixed plate 24, wherein at the same time the pump head 6 pivoted thereto is pressed and advanced against the central tube portion 20*a*. Since the pushing path of the pushing element 18 up to the abutment against the fixed plate 24 is longer than the distance between the inserted tube 20 and the pump head 6 in the completely opened state, the pump head 6 is consequently pressed so-to-speak through the tube 20, the central tube portion 20*a* being tensioned between the holding fixtures 22/notches 12 around the pump head 6 over a partial periphery thereof. In the completely closed state of the tube mounting case 1 according to the left-hand representation in FIG. 1 the central tube portion 20*a* is thus elastically deformed in U-shape, thereby a predetermined contact force resulting between the pump head 6 and the tube 20.

In the course of the swivel motion of the handle 16 in the closing or tensioning direction the handle exceeds kind of a dead center of the lever mechanism, whereupon the handle 16 is forced in the direction of the tensioned end position of the handle (according to the left-hand representation in FIG. 1) while the already generated tensioning force of the central tube portion 20*a* on the pump head 6 is exploited. I.e. the lever mechanism according to the first embodiment of the invention is equipped with a kind of self-locking to maintain the handle 16 automatically, without any additional locking elements, in the tensioned end position thereof.

Figure 2:
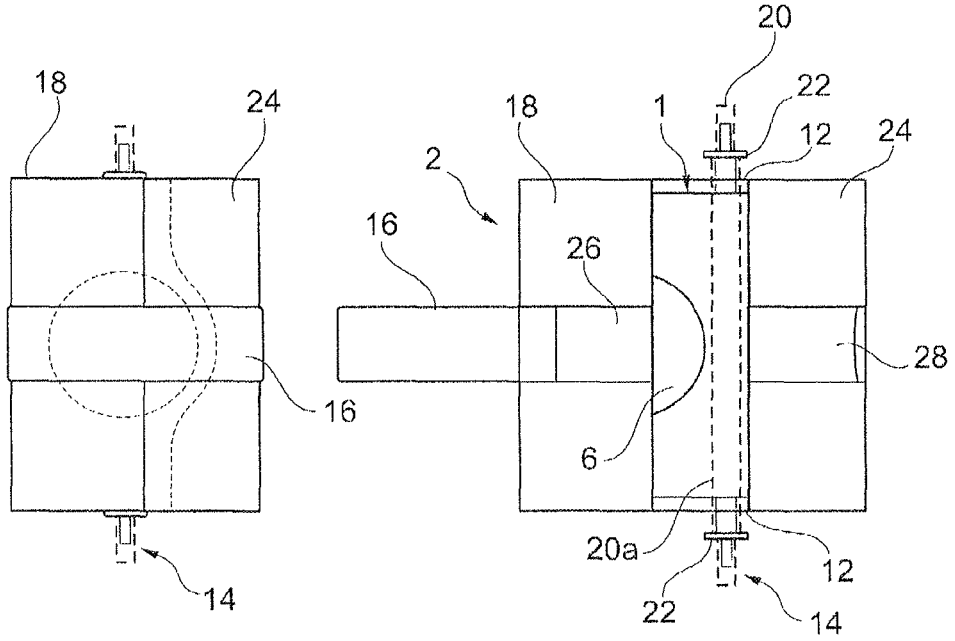
FIG. 2 shows a second preferred embodiment of the invention comprising a manually operable lever mechanism as tensioning device including a stationary tube mount and a buckle-type handle in the open (loose) and closed (tensioned) state.
Figure 3:
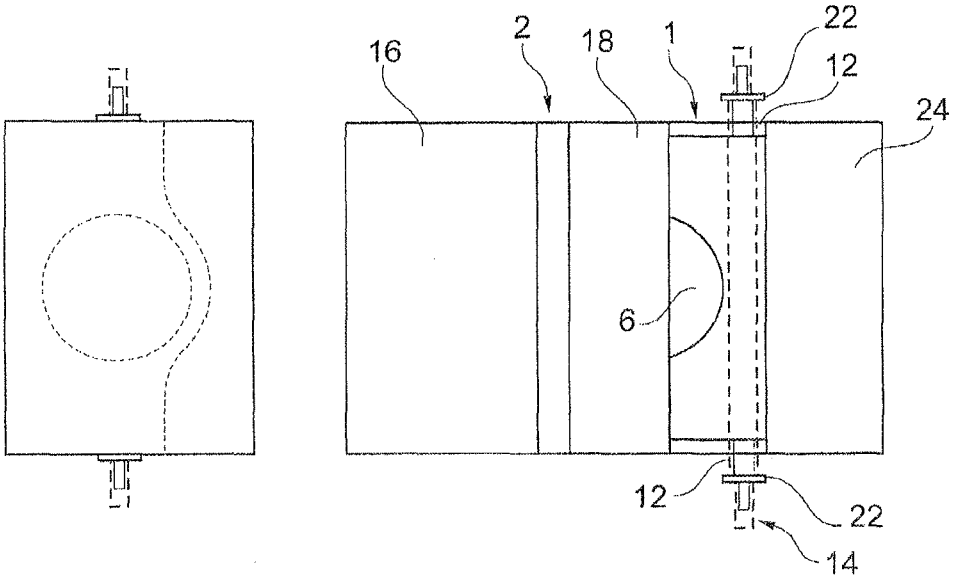
FIG. 3 shows a third preferred embodiment of the invention comprising a manually operable lever mechanism as tensioning device including a stationary tube mount and a plate-like handle in the open (loose) and closed (tensioned) state.

FIGS. 2 and 3 illustrate alternative configurations of the tensioning device 2 according to FIG. 1, wherein hereinafter merely the technical differences from the first embodiment will be discussed, while all other technical features substantially correspond to the first embodiment.

The embodiments according to FIGS. 2 and 3 differ from the first embodiment according to FIG. 1 by the configuration of the manually operable handle 16. According to FIG. 2, the handle 16 is in the form of a strip-type buckle, whereas the plate-shaped pushing element 18 according to the right-hand representation in FIG. 2 is configured at its upper side with a longitudinal groove 26 in the pushing direction of the pushing element 18 which is facing the buckle 16. In this case also the fixed plate 24 is formed to have an appropriate longitudinal groove 28 being aligned with the longitudinal groove 26 in the pushing element 18.

The longitudinal groove(s) 24, 26 is (are) dimensioned so that upon folding into its tensioning end position according to the left-hand representation in FIG. 2 the buckle 16 swivels into the groove(s) 24, 26 and is almost completely accommodated in the same. Thus a substantially plane and smooth upper side of the plate-shaped pushing element 18 and the fixed plate 24 is resulting so that inadvertent opening of the buckle 16, for example as a result of getting hooked on the same is safely prevented. This contributes to further improving the safety of the peristaltic pump according to the invention.

Finally the handle 16 according to the right-hand representation in FIG. 3 may also consist of a plate-shaped door which, after being folded into its tensioned end position (cf, left-hand representation in FIG. 3), completely covers the tube mounting case 1 preferably including the fixed plate 24.

Figure 4:
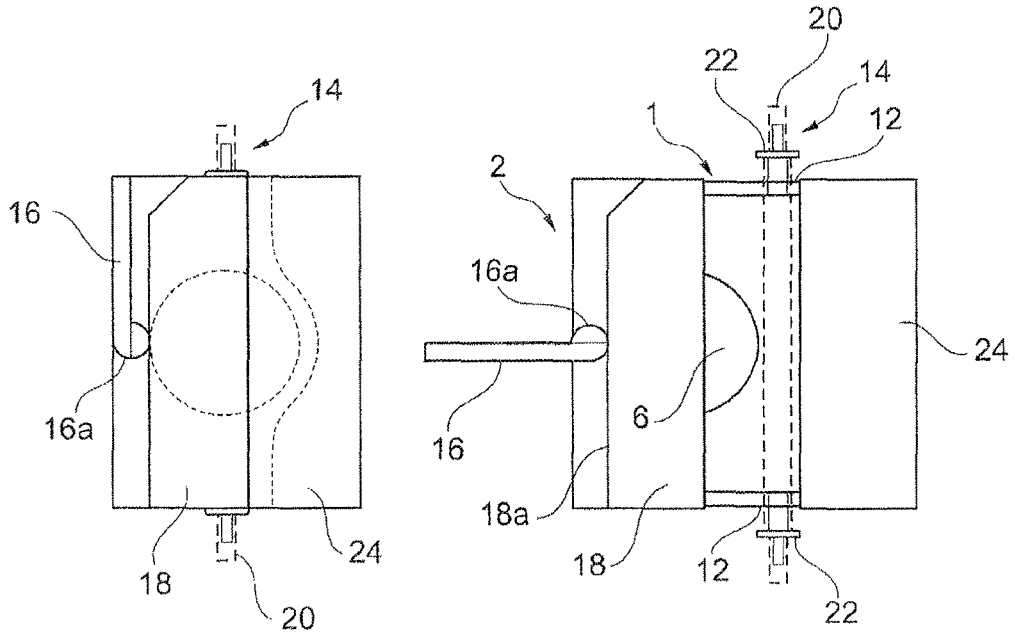
FIG. 4 shows a fourth preferred embodiment of the invention comprising a manually operable lever mechanism as tensioning device including a stationary tube mount and a knee lever-type handle in the open (loose) and closed (tensioned) state.

The embodiment according to FIG. 4 basically corresponds to the afore-described embodiments, wherein in this case the handle 16 is in the form of a knee lever, however. Concretely speaking, the knee lever 16 is hinged to the tube mounting case 1 or to the pump housing 4 so that the swivel axis thereof extends perpendicularly to the front side of the pump housing 4 and thus perpendicularly to the upper side of the plate-shaped pushing element 18. The knee lever 16 is formed to include an eccentric or a cam 16*a* which upon rotation of the lever 16 presses against the pushing element 18 and displaces the latter in the closing direction against the inserted tube 20. Since the knee lever 16 includes no coupling to the pushing element 18 but only contacts the one rear edge 18*a* thereof, in the present case a spring (means) not shown in detail is provided for pre-tensioning the pushing element 18 in the opening direction (loose end position according to the right-hand representation in FIG. 4). Also the knee lever 16 is positioned so that upon reaching its tensioned end position (cf. left-hand representation in FIG. 4) it has exceeded an (upper) dead center of the cam 16*a* and thus is automatically maintained in this position.

All embodiments according to FIGS. 1 to 4 have in common that the tube mount is configured/arranged to be stationary in the tube mounting case/tray 1 in the form of the two aligned notches 12, whereby it is necessary for tensioning the tube 20 to movably support the pump head 6 in the direction of the tube unit 14. However, it is basically also possible to maintain the pump head 6 stationary in the tube mounting case 1 and instead to movably support/guide the tube mount 12 in the tube mounting case 1. In this case the tensioning device 2 has to act on the tube mount 12 and not on the pump head 6. Hereinafter this functional principle will be described by way of the example of FIGS. 5 to 7.

Figure 5:
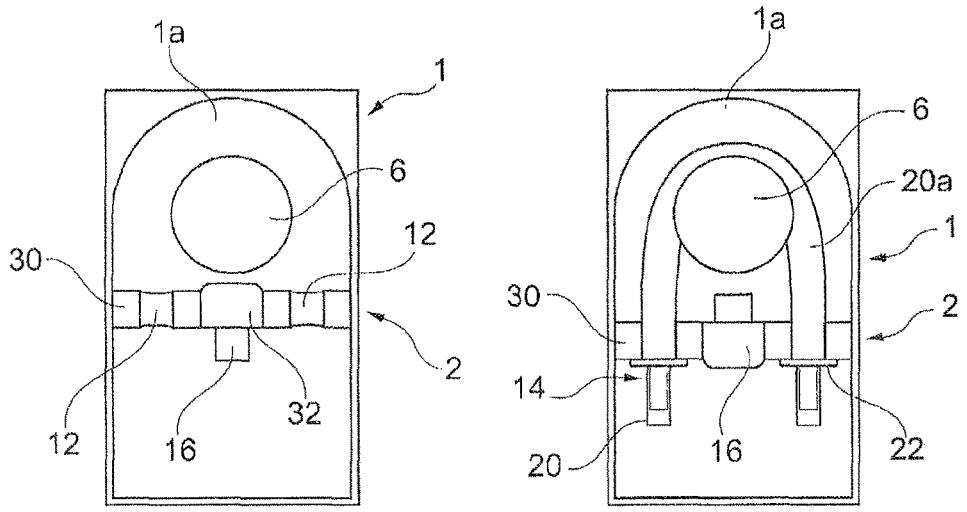
FIG. 5 shows a fifth preferred embodiment of the invention comprising a manually operable lever mechanism as tensioning device including a displaceable/movable tube mount and a button-type handle in the loose and tensioned state.

Accordingly, FIG. 5 illustrates a fifth embodiment of the invention as a simple design for realizing the afore-mentioned alternative tensioning principle.

In this case, the pump head 6 according to FIG. 5, left-hand representation, is rotatably supported (to be stationary) in the tube mounting case 1 and is driven by a motor not shown in detail inside the pump housing 4. The tube mounting case 1 is guided in semicircular shape around the pump head 6, thereby kind of a U-shaped mounting tray or groove 1*a* being formed between the tube mounting case 1 and the pump head 6.

On the side of the pump head 6 radially opposing the mounting tray 1*a* a beam-type mount 30 is supported in the tube mounting case 1 so that the beam 30 orientated substantially tangentially to the pump head 6 is movable in the transverse direction thereof. In a central portion of the beam 30 (the beam-type mount) a longitudinal slit 32 extending in the pushing direction of the beam 30 through which a lever-type handle 16 in the form of a button at its free protruding end extends is formed in the tube mounting case 1. The handle 16 is pivoted in the pump housing 4 at its other end which is not visible. In an axial central portion of the lever-type handle 16 the latter includes a drive element not shown in detail which is operatively connected to the beam-type mount 30 so as to transform a swivel motion of the handle 16 into a pushing motion of the beam 30 when the lever mechanism generated hereby is appropriately reduced.

As can be further inferred from FIG. 5, right-hand representation, the tube unit 14 equally includes two axially spaced collar-type holding fixtures 22 which are adapted to be brought into undercutting engagement with notches 12 in the movable beam-type mount 30. However, in this case the axial distance between the two holding fixtures 22 along the tube 20 is so large that the central tube portion 20*a* between the holding fixtures 22 bulges into a U-shaped loop when the holding fixtures 22 or the tube 20 are/is laid/inserted in the beam-type tube mount 30 at the notches 12 thereof. The loop has a mean radius approximately corresponding to the U-shaped mounting tray 1*a* around the pump head 6 so that the central tube portion 20*a* can be laid around the pump head 6 in the loose state almost without any effort.

As soon as the tube unit 14 is inserted in the tube mounting tray 1*a*, the handle 16 is operated, i.e. in the present case is swiveled away from the pump head 6 and thus the beam-type mount 30 is pushed away from the pump head 6. In this way the central tube portion 20*a* contacts the partial periphery of the pump head 6 at a predefined tensioning force, as illustrated in the right-hand representation of FIG. 5.

As in the afore-described embodiments, the handle 16 according to the fifth preferred embodiment of the invention is dimensioned so that it exceeds a dead center shortly before reaching its tensioning end position (cf. right-hand representation in FIG. 5), whereupon the tensioning force of the tube 20 maintains the handle 16 in this tensioning end position.

The fifth embodiment of the invention according to FIG. 5 exhibits a comparatively simple mechanical structure, as the pump head 6 can be kept stationary and merely the (preferably beam-type) mount 30 has to be movable relative to the pump head 6. Hence this design can be manufactured at low cost. However, with this solution the rotating parts are exposed even in the tensioned end position of the handle 16.

Figure 6:
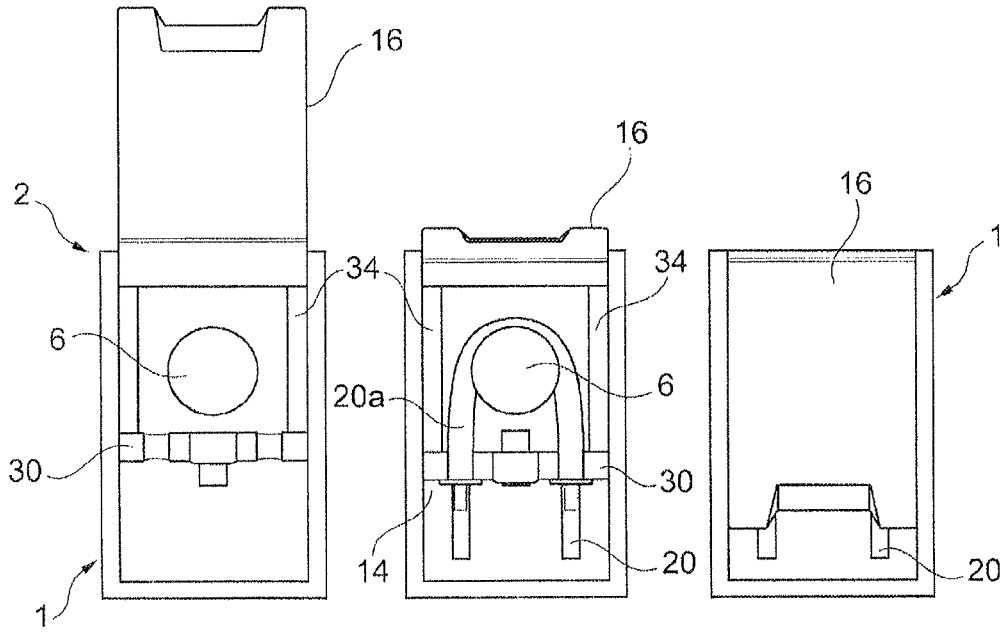
FIG. 6 shows a sixth preferred embodiment of the invention comprising a manually operable lever mechanism as tensioning device including a displaceable/movable tube mount and a plate-like handle in the open (loose) and closed (tensioned) state.

For solving this problem the sixth embodiment of the invention according to the left-hand representation in FIG. 6 provides a modified handle 16 in contrast to the fifth preferred embodiment. In this case, the afore-described button is replaced with a plate-shaped door which is hinged to the pump housing 4 via a hinge not shown and is operatively connected to the beam-type mount 30 via kind of a push rod member 34. The push rod member in the present case may be made of a bar frame hinged to a particular central position for obtaining a lever action at the pivoting door 16 as well as to the mount 30. Or else, the push rod member 34 can comprise two push rods movably supported laterally on the tube mounting case 1, the push rods being coupled to the handle 16 via a lever or gear mechanism so as to transform a swivel motion of the handle 16 into a pushing motion of the push rods.

The functioning of the tube mounting case 1 and especially of the tensioning device including the lever mechanism 2 according to the sixth embodiment of the invention is substantially similar to that of the fifth embodiment. I.e. the swivel motion of the plate-shaped door 16 is transformed via the push rod member 34 into a displacing motion of the beam-type mount 30, wherein, however, simultaneously with tensioning the tube unit 14 (cf. central representation of FIG. 6) the door-type handle 16 covers the tube mounting case 1 substantially completely upon reaching the tensioning end position according to the right-hand representation in FIG. 6. In this case, too, the tensioning device 2 is provided with a self-locking as described already before by way of the fifth embodiment.

Ultimately it is pointed out that the handle/operating element need not absolutely be operated manually but can also be motor-driven. Such motor can basically be used in all afore-described embodiments so as to apply an operating force to the handle/operating element via a gear unit or a piston, for example. However, the use of a motor drive also permits a modification of the tensioning device as described hereinafter by way of the seventh preferred embodiment according to FIG. 7, central representation.

Basically this case relates to a tube mounting case 1 comprising a fixedly held pump head 6 and a plate-shaped cover cap 16 which is movably guided on the pump housing 4 or the tube mounting case 1. The cover plate 16 includes a mount for the tube unit 14 consisting of two spaced notches 12 which are aligned relative to each other and into which the tube unit 14 can be inserted by way of undercut by means of holding fixtures/engaging elements 22 fastened thereto (cf. the right-hand representation in FIG. 7 in this respect). The distance between the two holding fixtures 22 is selected so that the tube 20 substantially follows the alignment between the notches 12 in the inserted but still loose state.

In the present case, the drive is formed by an electric motor not shown which is operatively connected to the cover plate 16 via a lever mechanism comprising an eccentric/cam and a push rod member. As an alternative, also other designs for a lever mechanism such as a gear unit are imaginable.

Figure 7:
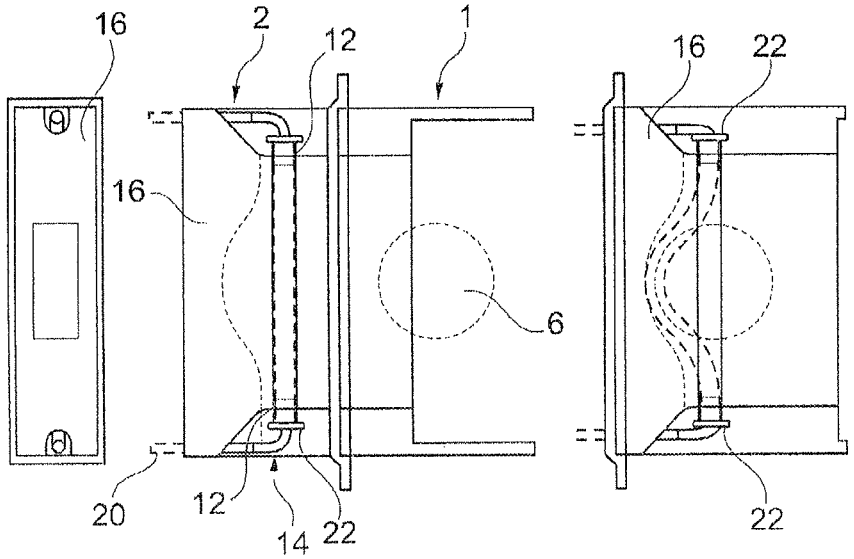
FIG. 7 shows a seventh preferred embodiment of the invention comprising a motor-drivable lever mechanism as tensioning device including a displaceable/movable tube mount and a gear unit as lever mechanism between the drive motor and the tube mount in the open (loose) and closed (tensioned) state.

By activating the motor a pushing force is applied to the cover plate 16 via the lever mechanism, thereby the cover plate being displaced from an open end position according to the central representation in FIG. 7 toward the pump head 6. In the course of this pushing motion, the tube 20 contacts the pump head 6 and is tensioned around the pump head 6 when the cover plate 16 is further displaced up to the tensioning end position. The self-locking effect is produced in this case either by the motor or by the downstream lever mechanism.

Figure 9:
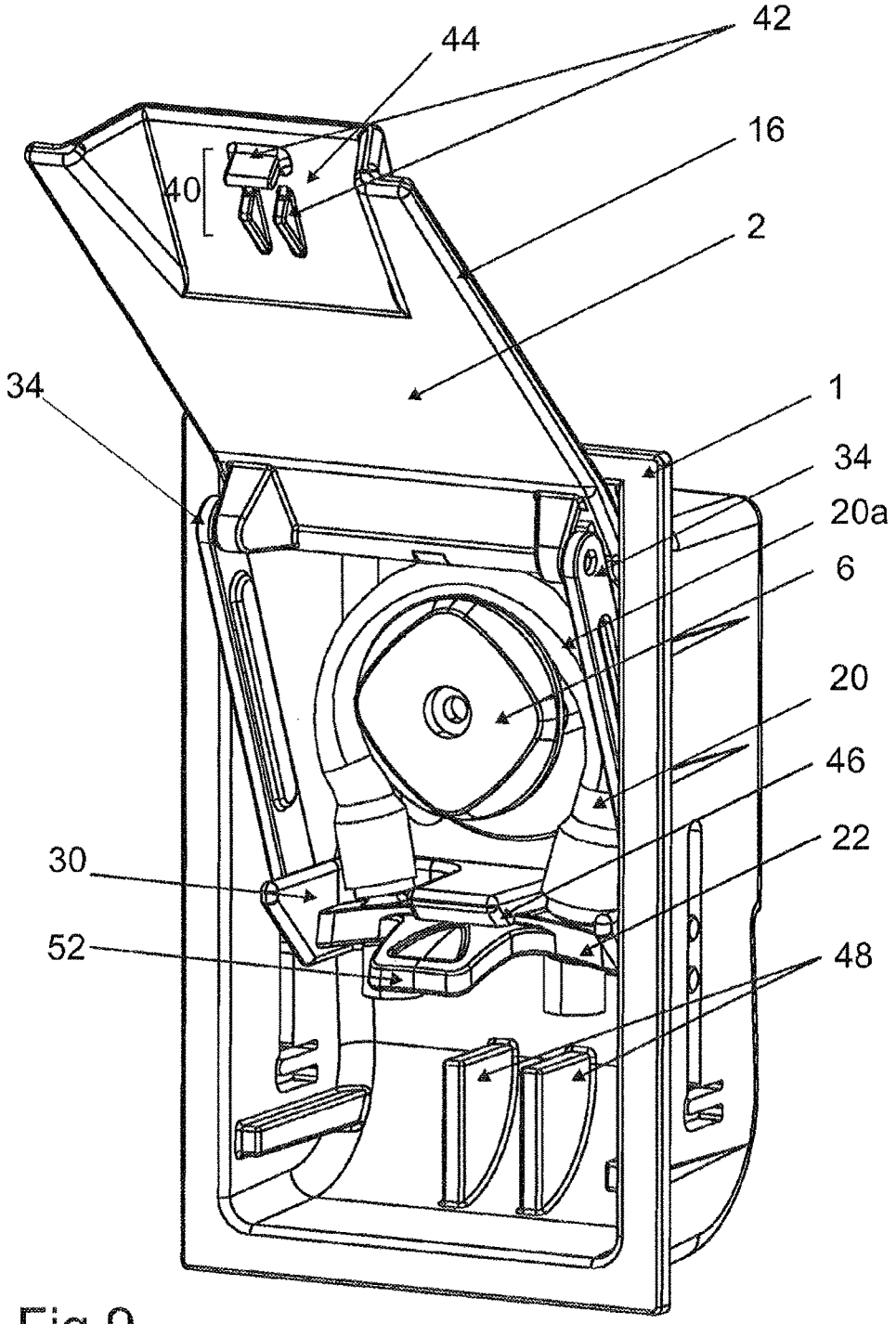
FIG. 9 shows the concrete configuration of the lever mechanism according to the present invention including a door-like lever element as a handle (operating element) as well as a stationary pump rotor and a displaceable tube mount as part of the lever mechanism and including an already inserted tube unit in a perspective view.

In FIG. 9, the tensioning device 2 according to the invention is in the form of the lever mechanism, presently for displacing the tube fixture 14 and, resp., the tube mount 30, illustrated in detail in the perspective. For a better representation of an engaging mechanism according to the invention for locking the tensioning device in the maximum tube tensioning position the tensioning device is depicted in the opened position. It is noted in this context that the lever mechanism may also be provided for displacing the pump head instead of the tube fixture, where appropriate.

Accordingly, the operating element of the lever mechanism is the protective cap or protective door 16 (might also be a pivoting bracket) pivoted on the tube mounting case/pump housing by which at the same time the tube mounting case 1 is covered (at least partially) in the tube tensioning position on the front side. On the inside of the operating element (protective door) 16 facing the tube mounting case 1, a clamping or locking device 40 is arranged preferably in the form of a spring clamp/snap means which in a further preferred manner may form an undercut acting in the opening movement direction of the operating element 16.

Concretely speaking, the clamping/locking device 40 on the one side of the protective door 16 of the lever mechanism includes two strip-like projections 42 aligned in parallel which project from the rear side of the protective door 16 toward the tube mounting case 1 and form a clamping or locking clearance (groove) 44 there between. The projections 22 can be formed substantially without any surface structure (exclusively for obtaining a clamping effect) or they include at least one undercut approximately in the form of a beading (clamping and/or locking effect) at their respective free (leading) edge. As a matter of course, the clamping/locking device 40 can also exhibit a different design, for example in the form of a mushroom-shaped base or similar push/engaging buttons.

According to FIG. 9, on both sides of the protective door 16 the two pressure push rods 34 are hinged the free ends of which are linked to the tube mount 30 movably supported in the tube mounting case 1 relative to the rotatable pump head 6. In this way a swivel motion of the protective door 16 is transmitted to the tube mount 30 (part of the lever mechanism) via the two push rods 34 at a particular lever ratio for displacing the same relative to the pump rotor/pump head 6.

The tube mount 30 is configured as a lock beam or frame comprising a driving/locking hook 46 projecting from a central portion of the frame 30 transversely to the displacing direction. The displacing path of the frame 30 in the tube tensioning direction (i.e. away from the pump rotor 6) is limited by a stop or stop projection 48 which in the tube mounting case 1 projects from the rear wall thereof into the mounting case space in tab or tongue shape and which thus, according to FIG. 9, is arranged beneath the frame 30 (tube mount) viewed in the tube tensioning direction.

Figure 12:
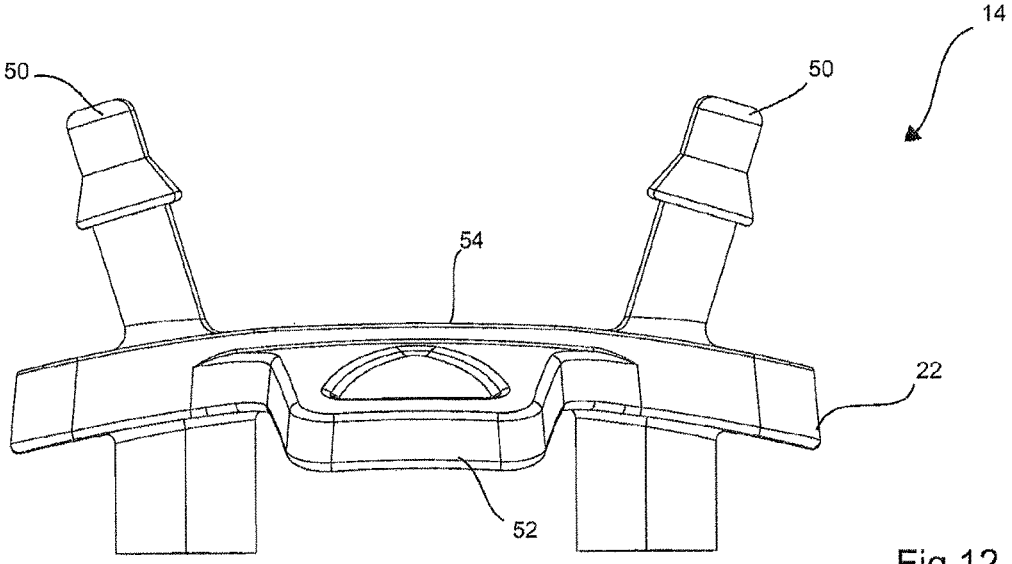
FIG. 12 shows the side view of the tube unit according to FIG. 11.
Figure 11:
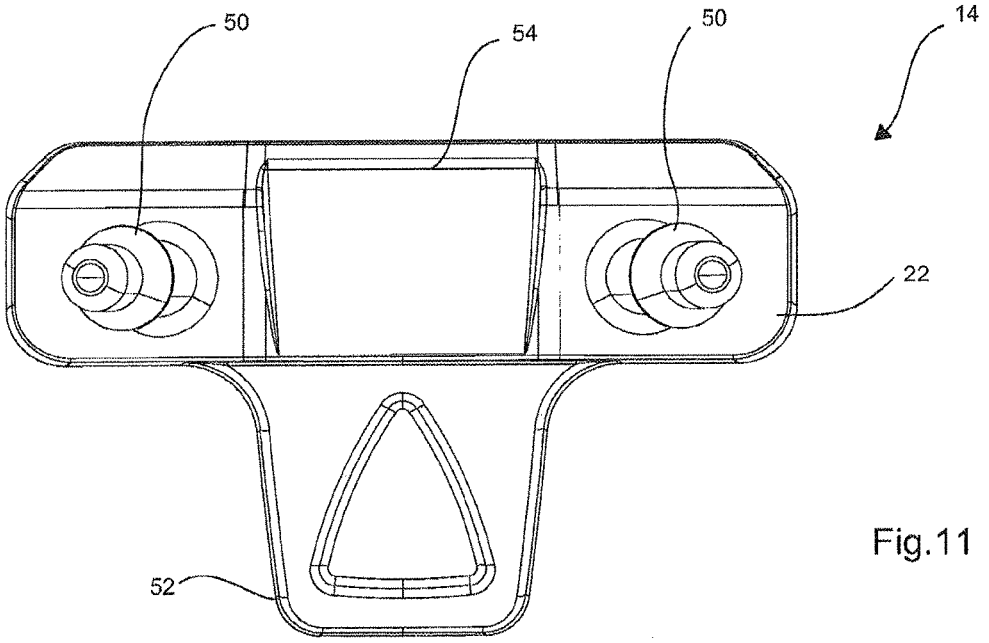
FIG. 11 shows the top view of a separately manufactured tube unit according to the invention (as a one-way article)

The (separate) tube unit 14 according to FIGS. 11 and 12 comprises the flexible/elastic tube 20 as well as the tube fixture 22 in this case being beam-shaped and having at each of its free ends a connecting nipple 50 to which the two tube ends are connected while forming a tubing loop. Moreover the two connecting nipples 50 also constitute a connecting option for two external connecting tubes (not shown in detail). In a central portion of the beam-type tube fixture 22 a tab 52 projecting transversely hereto is formed which initially serves as a handle (handle piece) for simple mounting and dismounting of the tube unit 14 into/from the tube mounting case 1. However, this tab 52 is arranged so that after inserting the tube unit 14 into the tube mounting case 1 (while partly enclosing the pump rotor 6) it projects in the direction of the mounting case opening and, resp., in the direction of the protective or cover door 16.

The tab 52 may be provided either without any surface structure (exclusively for achieving a clamping effect) or with an undercut (for achieving a locking effect), as will be described hereinafter.

Moreover, in the central portion of the beam-type tube fixture 22 a locking edge 54 is formed which can be hooked/locked (clipped) with the driving/locking hook 46 of the frame 30 when the beam-type tube fixture 22 is inserted/clipped into the locking beam or frame-like tube mount 30.

Figure 10:
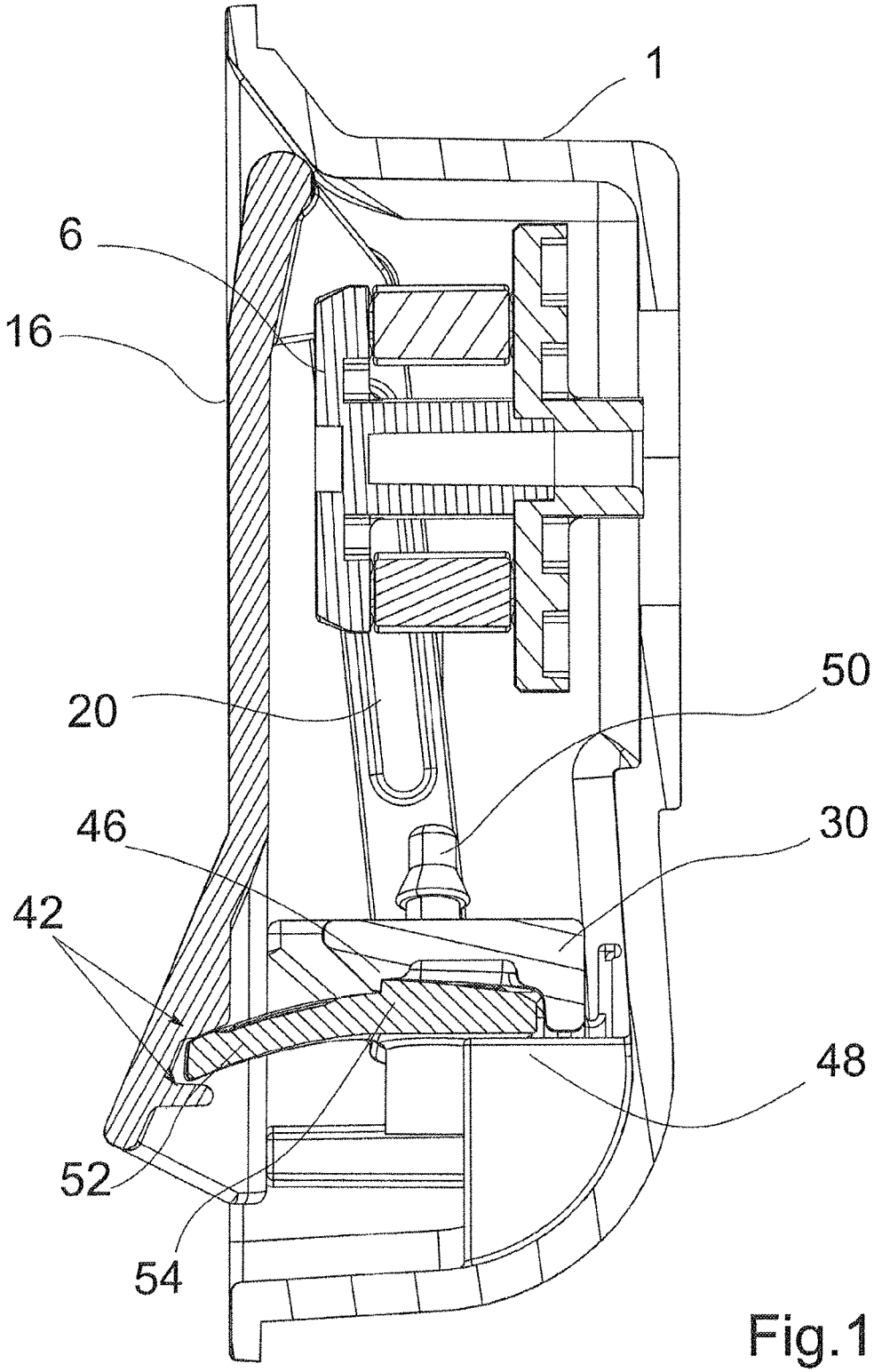
FIG. 10 shows the side view of the lever mechanism including an inserted tube unit according to FIG. 9 in the tube tensioning position (with the front door being closed)

This inserting/clipping position especially with a closed the cover door 16 of the lever mechanism is shown in FIG. 10.

Accordingly, first with the opened cover door 16 (also corresponding to the operating element of the lever mechanism) the tube unit 14 is inserted into the tube mounting case 1 via the front side mounting case opening by laying the loop-shaped tube 22 around the pump rotor 6 and inserting the beam-type tube fixture 22 in the lower side of the tube mount or the frame 30 with respect to the pump rotor 6. The undercut 54 is elastically locked/clipped on the side of the tube fixture 22 with the driving/locking hook 46 on the side of the frame 30 so that the tube fixture 22 can be removed from the frame 30 only with difficulties when the elastic locking is overcome. At the same time the driving/locking hook 46 presses on the tube fixture 22 in the tube tensioning direction; i.e., when the frame 30 is displaced in the tube tensioning direction via the lever mechanism, the driving/locking hook 46 presses onto the tube fixture 22 so as to carry the same along. The loop-shaped tube 20 is passed on both sides of the driving hook 46 by the same in the direction of the pump rotor 6, as is especially shown in FIG. 9. Moreover, in this inserted position of the tube unit 14 the tab 52 of the tube fixture 22 projects in the direction of the (front side) opening of the tube mounting case 1 and thus is arranged, viewed in the tube tensioning direction, beneath as well as ahead of the driving/locking hook 46 of the frame 30.

When the cover door 16 is now turned over as operating element for tensioning the tube 20 and for closing the mounting case 1 (cf. FIG. 10), the frame 30 is simultaneously displaced in the tube tensioning direction while driving the beam-type tube fixture 22 and the tube 20 is elastically tensioned around the pump rotor 6 (stretched in the longitudinal direction thereof).

Upon reaching the maximum tube tensioning position of the cover door 16, the tab 52 at the tube fixture 22 is inserted into the clearance 44 between the clamping/locking strips 42 on the side of the cover door 16 and is clamped and/or locked therein. At the same time the tube fixture 22 abuts against the stop projection 48 of the mount case 1 or is located in direct vicinity of the stop projection 48 such that the tube fixture 14 is (substantially) prevented from being further pushed in the tube tensioning direction.

As is evident from FIG. 10, the cover door 16 as operating element of the lever mechanism/tensioning device is held in the maximum tube tensioning position (folded down position) by the tab 52 on the tube fixture 22 (to prevent swinging open), the latter being engaged in the clamping/locking means 40 on the rear side of the cover door 16 for this purpose. The tube fixture 22 in turn is held to be locked by the driving/locking hook 46 at the tube mount/frame 30 (part of the lever mechanism). In order to prevent this locking between the frame 30 and the tube fixture 22 from inadvertently opening, the stop projection 48 is provided which in the maximum tube tensioning position prevents the tube fixture 22 from being further displaced (away from the driving/locking hook 48) or even presses the tube fixture 22 against the driving/locking hook 48.

Thus the entire subassembly consisting of the tube mount 30 including the driving/locking hook 46 formed on the same, the tube fixture 22 including the undercut 54 (provided in locking engagement with the driving/locking hook 46) and the tab 52 as well as the cover door 16 including the clamping/locking means 40 (being engaged in the tab 52)

is in the locked state by the stop projection 48 and can be re-opened only by overcoming the clamping/locking force between the tab 52 and the clamping/locking means 40 which is also dependent on the tensioning force of the tube 20 acting on the clamping/locking means 40 of the cover door 16 via the tube fixture 22/tab 52 in order to increase the friction fit.

Summing up, the present invention relates to a peristaltic pump for medical purposes comprising a pump housing in which a tube mounting case 1 is formed/inserted in which a pump head 6 is rotatably supported, and comprising a (separate) tube unit 14 being insertible/inserted into the tube mounting case 1 so that a tube 22 of the tube unit 14 engages in the pump head 6 for at least partially encompassing the latter. For this purpose, on the pump housing or tube mounting case 1 a tensioning device is arranged which interacts with the tube unit 14 or the pump head 6 so as to tension the tube 20 around the pump head 6 upon actuation thereof. In accordance with the invention, the tensioning device includes a lever mechanism, wherein preferably a lever element 16 of the lever mechanism at the same time forms or includes a protective cap for at least partly covering the tube mount 30/tube mounting case 1. A lever element (preferably the protective/cover door) further includes a clamping/locking means 40 which in the maximum tube tensioning position interacts with a counter-clamping/locking means 52 on the tube unit 14 so as to obstruct or prevent inadvertent relaxation of the tube 20.

The invention claimed is:

1. A medical peristaltic pump comprising:

a pump housing in which a tube mounting case is formed or fixedly inserted at a front side thereof, and in which a pump head is rotatably supported;

a flexible tube and a tube fixture beam holding the tube at two positions longitudinally spaced apart from each other along the tube such that the tube assumes a loop shape, said tube and tube fixture beam forming a tube unit as a separate replacement part, the tube unit being insertible or inserted into the tube mounting case so that by displacing the tube fixture beam or the pump head, the tube is pulled into tensioning engagement with the pump head while at least partially enclosing the pump head; and at least one lever element forming a part of a lever mechanism as a tensioning device for the tube unit to which at least one lever element is linked at the pump housing or at the tube mounting case and is coupleable or coupled to the tube fixture beam or the pump head for tensioning displacement of the lever mechanism, wherein a clamping or locking protrusion or recess is provided on the at least one lever element and is adapted to engage a counter-clamping or counter-locking protrusion or recess arranged on the tube fixture beam only in a tube tensioning position of the at least one lever element and the tube fixture beam for locking the tube fixture beam and the at least one lever element, the clamping or locking protrusion or recess being adapted to be disengaged from the counter-clamping or counter-locking protrusion or recess when the at least one lever element and the tube fixture beam are not in the tube tensioning position for releasing the tube fixture beam and the at least one lever element; and in that the tube mounting case in which the pump head is rotatably supported has a tube unit insertion opening for inserting the tube unit, the opening being arranged so that the tube mounting case is open only at the front side of the pump housing.

2. The peristaltic pump according to claim 1, wherein the at least one lever element of the lever mechanism constitutes or includes a protective cap or plate for at least partly covering the tube mounting case on a front side.

3. The peristaltic pump according to claim 2, wherein the protective cap either forms or is the at least one lever element, which is provided as a manual operating element or a handle of the lever mechanism, or forms or is the at least one lever element which is operable via the manual operating element or handle for transmitting force to the tube fixture beam or the pump head.

4. The peristaltic pump according to claim 1, further comprising a tube mount which is or can be movably arranged in or on the tube mounting case when the pump head is stationary and into which the tube is insertible or inserted by the tube fixture beam formed or fastened thereon.

5. The peristaltic pump according to claim 4, wherein the lever mechanism acts on the tube mount so as to move the lever mechanism relative to the stationary pump head so that a loop-type central tube portion being arranged in the tube mount is adjacent against the pump head in a way tensely encompassing the pump head.

6. The peristaltic pump according to claim 1, wherein the lever mechanism is additionally configured to be self-locking.

7. The peristaltic pump according to claim 1, further comprising a stop projection which is formed in the tube mounting case and, upon the tube fixation beam reaching the tube tensioning position, presses against the tube fixture beam, the tube fixture beam being movable, or is provided directly adjacent to the tube fixture beam so as to block further displacement of the tube fixture beam in the tube tensioning direction.

8. The peristaltic pump according to claim 7, wherein the counter-clamping or locking protrusion or recess on the side of the tube fixture beam is a tab having at least one snap strip formed thereon and the clamping or locking protrusion or recess is a spring/hook element arranged on a rear side of a door-type lever element which can be brought in clamping/locking engagement with the tab.

9. The peristaltic pump according to claim 8, wherein the tab forms a handle element for manually inserting the tube unit into the tube mounting case.

10. A tube unit of a peristaltic pump according to claim 1, wherein a tab protruding transversely to the tube fixture beam is formed which is adapted for manually handling the tube unit during an inserting/removing operation and for latching the lever mechanism in the tube tensioning position thereof.

* * * * *